US005600908A

United States Patent [19]

Högberg

[11] Patent Number: 5,600,908

[45] Date of Patent: Feb. 11, 1997

[54] DISPLAYING ELEMENT

[75] Inventor: Bo Högberg, Göteborg, Sweden

[73] Assignee: Mobitec AB, Sweden

[21] Appl. No.: 387,738

[22] PCT Filed: Sep. 21, 1993

[86] PCT No.: PCT/SE93/00763

§ 371 Date: Feb. 16, 1995

§ 102(e) Date: Feb. 16, 1995

[87] PCT Pub. No.: WO94/07231

PCT Pub. Date: Mar. 31, 1994

[30] Foreign Application Priority Data

Sep. 22, 1992 [SE] Sweden ..... 9202731

[51] Int. Cl.[6] ..... G09F 9/30

[52] U.S. Cl. ..... 40/449

[58] Field of Search ..... 40/449; 345/108, 345/109, 903, 905; 340/815.62

[56] References Cited

U.S. PATENT DOCUMENTS

| | | | |
|---|---|---|---|
| 3,518,664 | 6/1970 | Taylor . | |
| 3,624,647 | 11/1971 | Smith . | |
| 3,871,945 | 3/1975 | Winrow et al. . | |
| 3,925,777 | 12/1975 | Clark | 340/815.62 X |
| 3,996,680 | 12/1976 | Smith . | |
| 4,006,476 | 2/1977 | Romney | 340/815.62 |
| 4,069,480 | 1/1978 | Helwig . | |
| 4,488,148 | 12/1984 | Kuciera | 345/903 X |
| 4,860,470 | 8/1989 | Browne | 40/449 |

FOREIGN PATENT DOCUMENTS

| | | | |
|---|---|---|---|
| 0327250 | 8/1989 | European Pat. Off. | G09F 9/37 |

*Primary Examiner*—Joanne Silbermann
*Attorney, Agent, or Firm*—Zarley, McKee, Thomte, Voorhees & Sease

[57] ABSTRACT

A display element is adapted to be arranged together with other similar elements in rows and columns for displaying signs and comprises a housing (2), a surface element (6) connected to said housing and movable between two positions for displaying different surface information (4,5), as well as a coil (9) optionally magnetizable in opposite directions, connected to the housing and adapted to actuate the surface element to occupy one or the other of said positions depending upon the direction of said magnetizing. The display element is adapted to be selected to magnetize the coil thereof by activating the column or row to which it belongs through lines interconnecting all display elements arranged in a column and a row, respectively. Means (18,19) are integrated with the housing (2) and arranged to block magnetizing of the coil of the display element on activation of an interconnecting line (15 and 16,17, respectively) belonging to the row of the element as mentioned if the interconnecting lines (16,17 and 15, respectively) belonging to the column of this element are at the same time unactivated and conversely.

28 Claims, 5 Drawing Sheets

DISPLAYING ELEMENT

The present invention relates to a display element according to the preamble of the appended claim 1.

Such elements are used to construct different types of display tables intended to deliver information of different types, said information may be communicated in the form of one single sign (letter, figure or the like) of an amount of alphanumeric or other signs. For the sake of examplifying but in no way limitating information tables used in local traffic, such as in buses, undergrounds and the like, may be mentioned, which are intended for departure times, destinations, line number and the like. A matrix, i.e. a two dimensional field, of identical display elements is as a rule arranged for each sign to be displayed, so that for instance 5×7 display elements are arranged to display a letter, but any row and column combinations may of course be possible.

Display elements of this kind are previously known through U.S. Pat. Nos. 3,518,664 and 4,860,470. When these prior display elements are used for producing a display table having at least one matrix for displaying signs each end of the coil of the respective display element has to be connected, preferably by soldering, to an interconnecting line for a row or a column of the matrix arranged on an underlaying printed circuit card in common. It is described in U.S. Pat. No. 4,069,480 how this connection may be achieved, from which it appears that means for assisting in selecting a certain display element from the other, diodes in the described case, are arranged on the printed circuit card or control card and have to be connected in couples on one hand to the respective coil and on the other to an interconnecting line each running substantially perpendicularly to the interconnecting line for the interconnection of the coils. A construction of a matrix in this way enables a control of different display elements included in the matrix by sending an activating signal to an interconnecting line, to which the coil of the element in question is connected, and a signal to one of the two interconnecting lines to which the diodes connected to this coil are connected, whereby the magnetizing direction and thereby which of the two surfaces the surface element of the display element shows depends on which one of said two interconnecting lines is selected. By means of the two diodes it is achieved that only display elements receiving such a signal both on the column and the row thereof may be activated, since the barrier layer of the respective diode prevents a magnetizing of a coil belonging to a display element which has only received an activating signal on an interconnecting line for a row or a column.

Thus, by a displaying table constructed in the way described above a control electronic circuit required for controlling the display element may be considerably simplified with respect to the case in which each separate display element had to be subjected to a separate control, and manufacturing costs are saved as well as the risk of future failures of the displaying table is reduced.

However, a disadvantage with this type of displaying tables consists in that the manufacturing of said matrices by control cards in spite of all gets comparatively timeconsuming and complicated, since a considerable amount of connections between the different components on the control card and the display elements are required. Another disadvantage consists in that it is necessary, should the display elements be delivered separately for connection on a control card later on, that the latter is well adapted to the design and number of the display elements, so that there is no longer any flexibility desired in the assembling of the control card and the display elements in the final assembling of the displaying matrix.

BRIEF DESCRIPTION OF THE INVENTION

The object of the present invention is to provide a display element of the type mentioned in the introduction and described by U.S. Pat. Nos. 3,518,664 and 4,860,470, which makes it possible to simplify the construction of displaying matrices consisting of such elements and considerably improve the flexibility with respect to the choice of the final result during this construction, so that it is possible to reduce the costs for the very manufacturing of displaying tables consisting of such elements.

This object is in accordance with the invention obtained by providing a display element according to the appended claim 1.

By integrating blocking means in a display element of the type described in U.S. Pat. Nos. 3,518,664 and 4,860,470, which means makes it possible to block magnetizing of the coil of the the display element on activation of an interconnecting line belonging to the row of the element last mentioned if the interconnecting line belonging to a column of this element is at the same time unactivated and conversely, a display element is obtained, which may be assembled in a considerably simpler way than before to other similar elements for forming rows and columns for displaying signs. The assembly itself of the blocking means may be accomplished by the same equipment which assembles the rest of the members of the display element, which means that the production of a possible carrier for a display element only has to involve the arrangement of the different interconnecting lines on these carriers and not any soldering of other components, such as diodes, thereon. Thus, it gets considerably easier to provide inexpensive carriers which at the moment of the very assembling of the display elements thereon may be cut into the dimensions desired in the very particular case, since the cost for rest material possibly resulting will be considerably lower than previously possible.

Furthermore, a display element according to the invention makes it in addition thereto possible to considerably reduce the total number of connections between the display elements and a carrier, such as a control card, therefor, if the housing of the display element is adapted to receive a portion of said interconnecting lines for a column and a row, respectively, in which the display element is locatable, and said portion is provided with connecting means for connecting to matching connecting means of an identical display element locatable adjacently to the display element, as is defined in a dependent claim.

A further object of the present invention is to enable the production of display matrices made of display elements of the type mentioned in the introduction in a considerably easier and thereby less expensive way than previously possible.

This object is obtained by providing a module of two or more display elements according to the preamble of the appended claim 1, said display elements being assembled to each other and forming together a part of a row and/or a column of the matrix of display elements, which is characterized in that it is made of display elements of the type according to the invention and defined above.

By combining several display elements according to the invention in a module the possibility is provided to substantially simplify the assembling of the display elements needed for forming a desired matrix and producing the interconnecting lines therebetween and the connections to lines for supplying signals activating different rows and columns.

Thus, the interconnecting lines in question between the display elements in said row and/or column part may in accordance with the preferred embodiment of the invention be integrated with the module, by which the total number of connections between a carrier and the display elements may be most substantially produced. It is even possible to produce a module according to the invention having a size of a matrix for displaying a sign asked for, wherein only the display elements located at the two ends of the respective row or column of the display elements included in the module have to be provided with connecting means or pins for connecting said interconnecting lines for the row or column in question to a control card, or this may even be omitted and the connections may be created directly to lines leading to a control unit for delivering activating signals. This is possible on the whole thanks to the integration of the blocking means mentioned above with the housing of the respective display element.

Further advantages as well as advantageous features of the invention will appear from the following description and the other appended dependent claims.

BRIEF DESCRIPTION OF THE DRAWINGS

With reference to the appended drawings, below follows a description of preferred embodiments of the invention cited as examples.

In the drawings.

DETAILED DESCRIPTION OF PREFERRED EMBODIMENTS OF THE INVENTION

Figure 1:
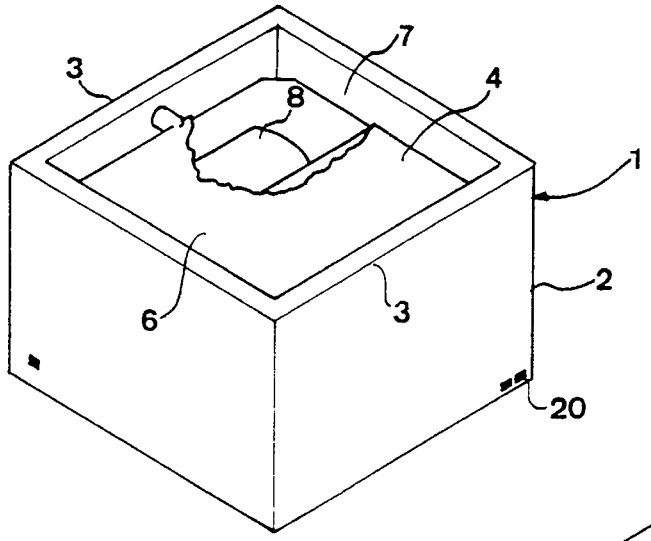
FIG. 1 is a simplified perspective view of a display element according to a first embodiment of the invention with a part broken away.
Figure 2:
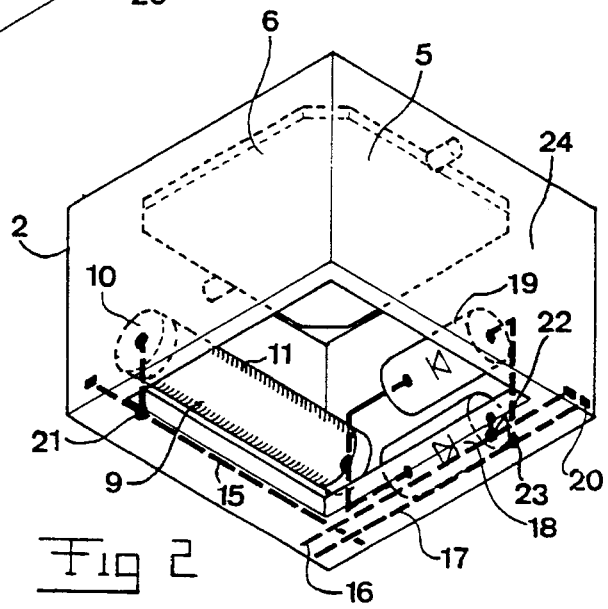
FIG. 2 is a perspective view of the element of FIG. 1 from another direction, on which hidden components are indicated by dashed lines.

FIGS. 1 and 2 are simplified views of a presentation or display element 1 according to the invention and intended to make the inventional idea clear. The display element comprises a housing 2, which consists of a box opened upwardly, which preferably is provided with a bottom, although this has been omitted in FIG. 2 for making it clearer. A surface element 6 having two large surfaces 4, 5 is in the upper section of two opposed walls 3 pivotally arranged between two positions for showing a respective surface in the direction of the opening 7 of the display element (upwardly as seen in FIG. 1). Stop means not shown are preferably arranged for defining these two positions, against which stop means the surface element 6 comes to bear in the pivoting thereof. The two surfaces 4 and 5 are provided with different colours, so that they may communicate different information to the environment.

A permanent magnet 8 indicated by the breaking away in FIG. 1 is embedded in the surface element 6. Furthermore, a magnetisable coil 9 is arranged in the housing 2, said coil being formed by a core in the form of a rod 10 and a wire winding 11 arranged outside thereon. The rod 10 is of a material having a high remanence, i.e. a high coercive force (coercive magnetic field strength), so that the coil 9 once magnetized in a direction maintains its magnetizing until it is remagnetized in the opposite direction. The coil 9 and the permanent magnet 8 are mutually arranged so that, when a current pulse is sent through the coil for magnetizing thereof in one direction, the surface element 6 is actuated through actuation of the magnet coil of the permanent magnet to pivot to one of the-two positions mentioned above. The surface element remains then in this position until a remagnetizing of the magnet coil is carried out by sending the current in the opposite direction therethrough, which then means that the surface element pivots to the other of the two positions and presents the other of its two surfaces outwardly. The north pole achieved at one end of the rod 10 by the magnetizing of the coil 9 will accordingly tend to repel the north pole of the permanent magnet 8 and attract the south pole of the latter in a way generally known.

Figure 6:
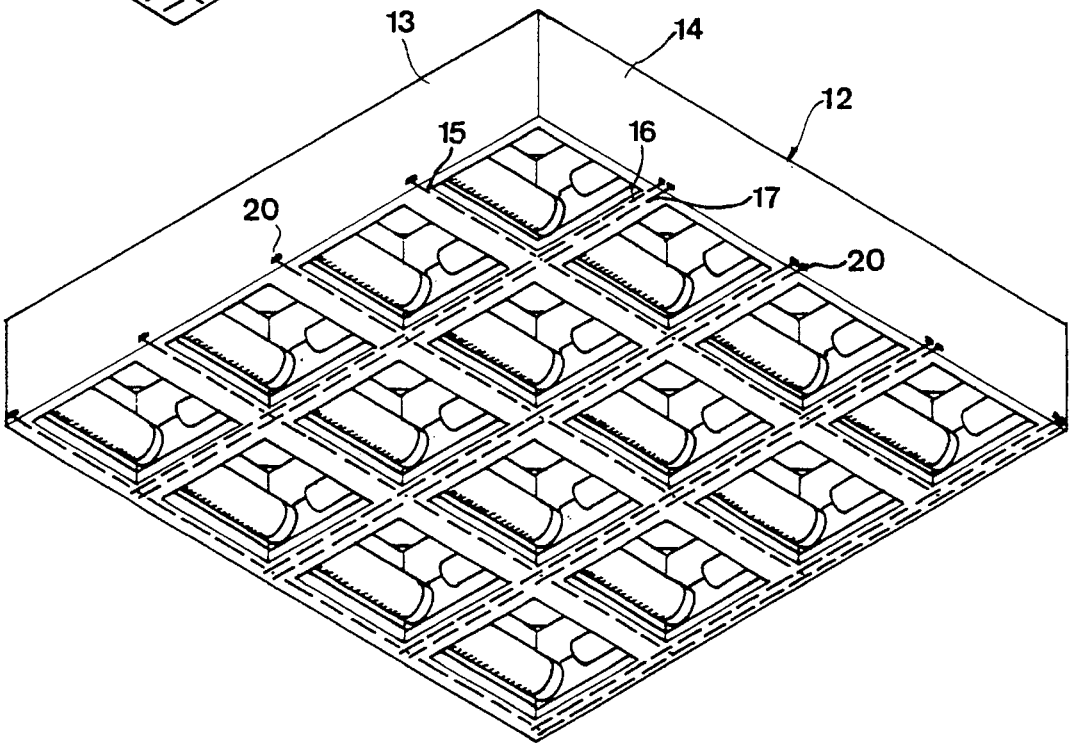
FIG. 6 is a simplified view from below of a module made of rows and columns of display elements according to FIG. 1.

The construction of a display element described so far is already known, and reference is now made to FIG. 6, which shows a matrix module 12 according to a preferred embodiment of the invention made of such display elements arranged in rows and columns, so as to explain the known principle of controlling such elements. The direction of the coils of the respective display element will hereinafter be called column 13 and the rows of display elements in the direction perpendicular thereto will be called rows 14, but it is evident that the case could in the practice be the reversed.

The display elements belonging to one and the same column 13 are connected to an interconnecting line 15 in common, while the display elements belonging to one and the same row 14 are each connected to two interconnecting lines 16, 17 in common extending in the direction of the row. It is known to select a desired display element, namely the one being located both in said row and said column, and control it to be magnetized by sending an impulse through a certain column interconnecting line and a row interconnecting line, and the current direction through the magnetizing coil of the display element in question and thereby the magnetizing direction of the latter and which surface shall be displayed by the surface element 6 is determined in dependence of which one of the two row interconnecting lines 16 and 17 is the one selected. For making this selection and control of a certain display element possible means will be required for ensuring that no other display elements located in the same column or row are actuated on sending an impulse in said column and row, and this has previously been achieved by arranging such blocking means on a control card onto which the display elements are arranged and then connect these electrically to the coil of each display element. However, this is in accordance with the invention obtained in a different way, and the new and characteristic features of the invention will be described hereinafter with reference made to FIGS. 2 and 6.

Means are integrated with each of the display elements according to the invention and arranged to block magnetizing of the coil of the display element on activation of an interconnecting line 16 or 17 belonging to the row of the display element if the interconnecting line 15 belonging to the column of this element is at the same time unactivated and conversely, so that these means 18, 19 thereby assist in the selecting of the display element. Such blocking means are formed by semiconductor components, which may be passive, such as diodes, or active, such as transistors, thyristors or the like. The blocking means are in the case shown in FIG. 2 constituted by two anti-parallelly coupled diodes 18, 19, which at one end thereof are connected to one end of the wire winding 11 and thereby of the coil 9 and at the other end thereof are connected to one of the two row interconnecting lines 16, 17 each, which accordingly are integrated in the housing of the display element and preferably extend along one wall thereof. The column interconnecting line 15 belonging to the column on the display element is also integrated in the housing 2 and extends along another wall of the housing arranged perpendicularly to the former wall. The three interconnecting lines 15, 16 and 17 have at the opposite ends of the housing connecting means 20 schematically indicated for connecting the respective line to a corresponding line of display elements arranged in the same row and column, respectively, for forming a row and column interconnecting line, respectively. The connecting means 20 could in the practice be constituted by a pin arranged in the housing at one end of the respective interconnecting line and intended to engage into a corresponding recess in an identical display element located therebeside, but it would also be possible that the connecting means 20 are constituted by projections or pins extending downwardly from the housing 2 for connection through a carrier in the form of a control card.

The end of the coil 9 opposite to the connection of the diodes 18, 19 thereto is by the wire winding thereof connected to the interconnecting line 15. Thus, the coil is thereby connected in series with the two diodes 18, 19 between a connection point 21 to the column interconnecting line 15 and a connection point 22, 23 to the respective row interconnecting line 16 and 17, respectively. The selection of the display element is taking place in the following way. If for instance a voltage of +24 V during a very short time is applied on the interconnecting line 15 and 0 V on the interconnecting line 16 and 17 for one and the same display element, the current will flow from the connection point 21 through the magnetic coil 9 and then through the diode 18 arranged in the forward direction, while the diode 19 arranged in the reverse direction will block, and to the connection point 22 of the row interconnecting line 16. Thus, the coil 9 will be remagnetized in accordance therewith and give rise to actuation of the permanent magnet 8 of the surface element, so that this element pivots and changes display surface 4 and 5, respectively. When the current flowing in the interconnecting line 16 advances in this interconnecting line past the next display element, no current will be able to enter thereinto, since the diodes 18 reversedly directed in this row prevent this. Furthermore, the current arriving to the display element 1 through the interconnecting line 15 will on reaching display elements in the same column not be able to pass through the coils thereof, since it is true that the interconnecting lines 16 and 17 belonging to all other rows are on 24 V just like the interconnecting line 15, but the diode 18 directed forwardly of these display elements will by the barrier layer thereof prevent conducting through any of the other coils, so that the completely reliable selection of the display element desired may be accomplished. When instead for example 0 V is shortly applied on the interconnecting line 15 and for instance 24 V on the interconnecting lines 16 and 17, the current will flow from the interconnecting line 17 through the diode 19 and the coil 9 to the interconnecting line 15 for remagnetizing of the coil in the opposite direction and thereby pivot the surface element 6 to presentation of the surface previously not shown. It is prevented that other coils than the one belonging to the determined row and column are magnetized in a way analogous to the one described above.

The diodes 18, 19 are preferably arranged on or embedded in a wall 24 of the housing 2, but they could also be arranged in the bottom of the housing or under the housing in a suitable connection, such as by pins, thereto. These arrangements of the diodes are intended to comprised by the expression "integrated with the housing" The number of connections to a carrier necessary may thanks to this integration of the diodes with the housing of the display element be reduced considerably, and such a carrier may furthermore be made much simplier than and less expensive than previously, so that it may without any frightening costs be provided in big pieces to be cut into exactly the size desired in the respective case on mounting the display elements.

Figure 3:
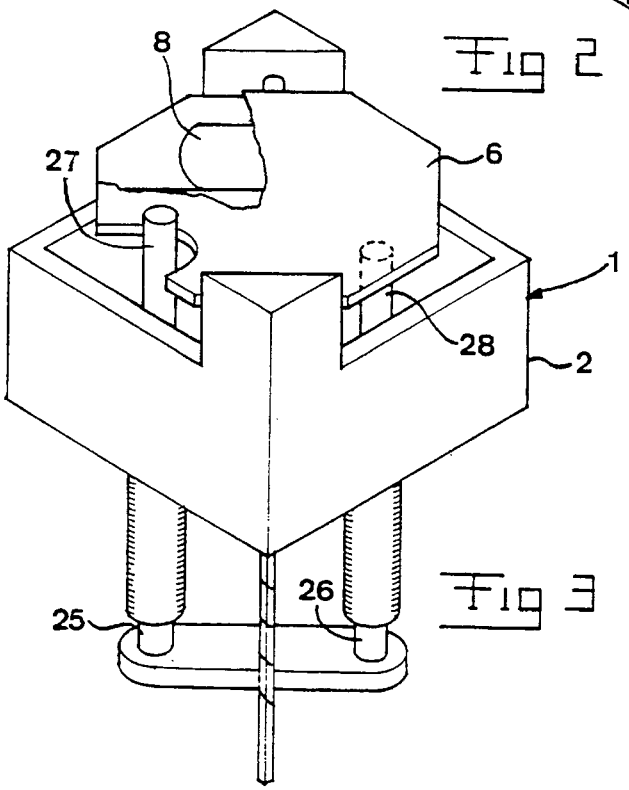
FIG. 3 is a perspective view obliquely from above of a display element according to a second preferred embodiment of the invention with certain parts broken away.
Figure 4:
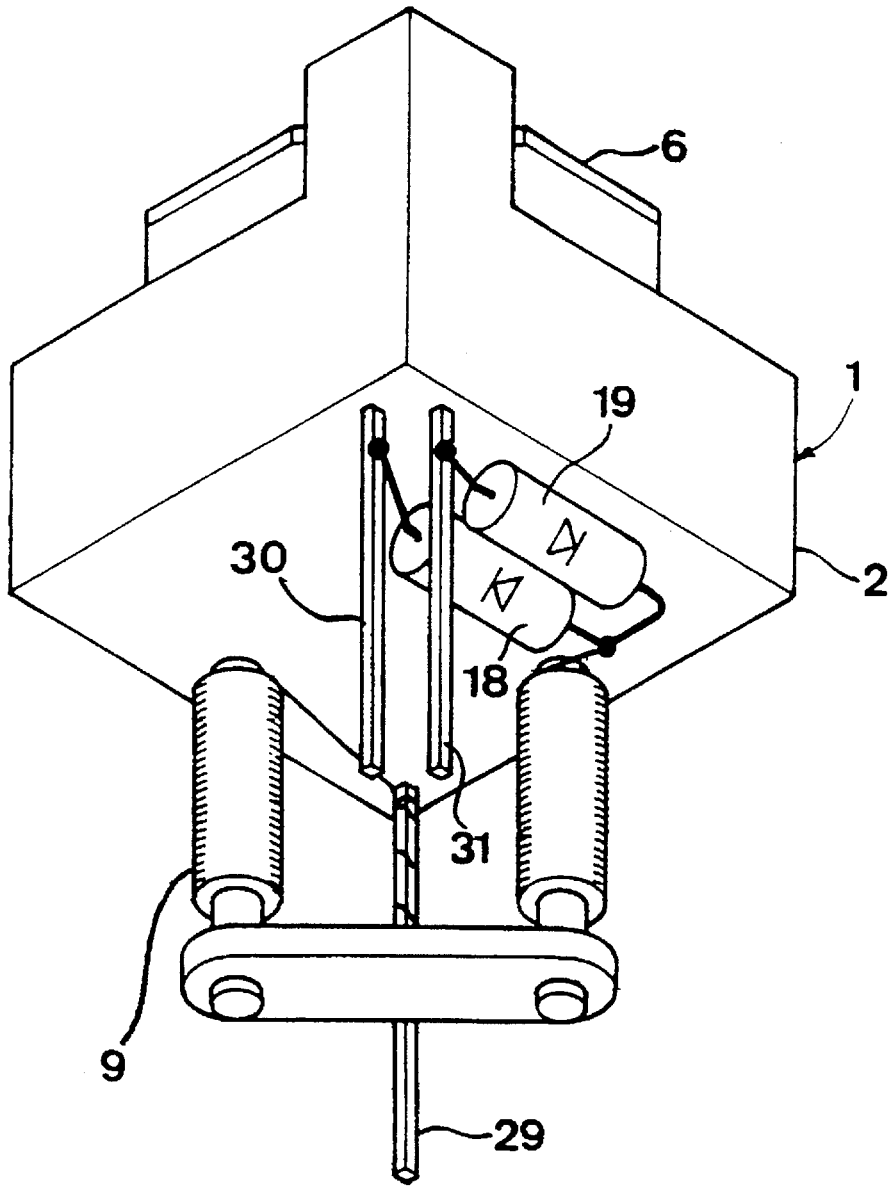
FIG. 4 is a perspective view from below of the display element according to FIG. 3.

A display element according to a second preferred embodiment of the invention is shown in FIGS. 3 and 4 for examplifying the invention. Pans of this display element having a direct correspondence to pans of the display element according to FIGS. 1 and 2 are provided with the same reference numerals. The function of the display element is the same as that of the one described above. The magnet coil is in this embodiment made of two pans 25, 26 having a rod 27, 28 each of a high remanence. Thus, on magnetizing of the coil for instance the end of the rod 27 will become the north pole of the magnet and the end of the rod 28 the south pole thereof. On pivoting the surface element 6 in the respective direction the end positions thereof will be defined by the fact that the rods 27 and 28 function as stop means. It appears from FIG. 4 how the diodes 18 and 19 are integrated with the housing 2, by being arranged on the bottom thereof, and the connecting means to the interconnecting lines to display elements arranged in the same row and column are in this embodiment constituted by pins 29, 30, 31 projecting downwardly and arranged to be connected to such interconnecting lines arranged on a control card or the like. Thus, the interconnecting lines do here not extend inside the display elements.

Figure 5:
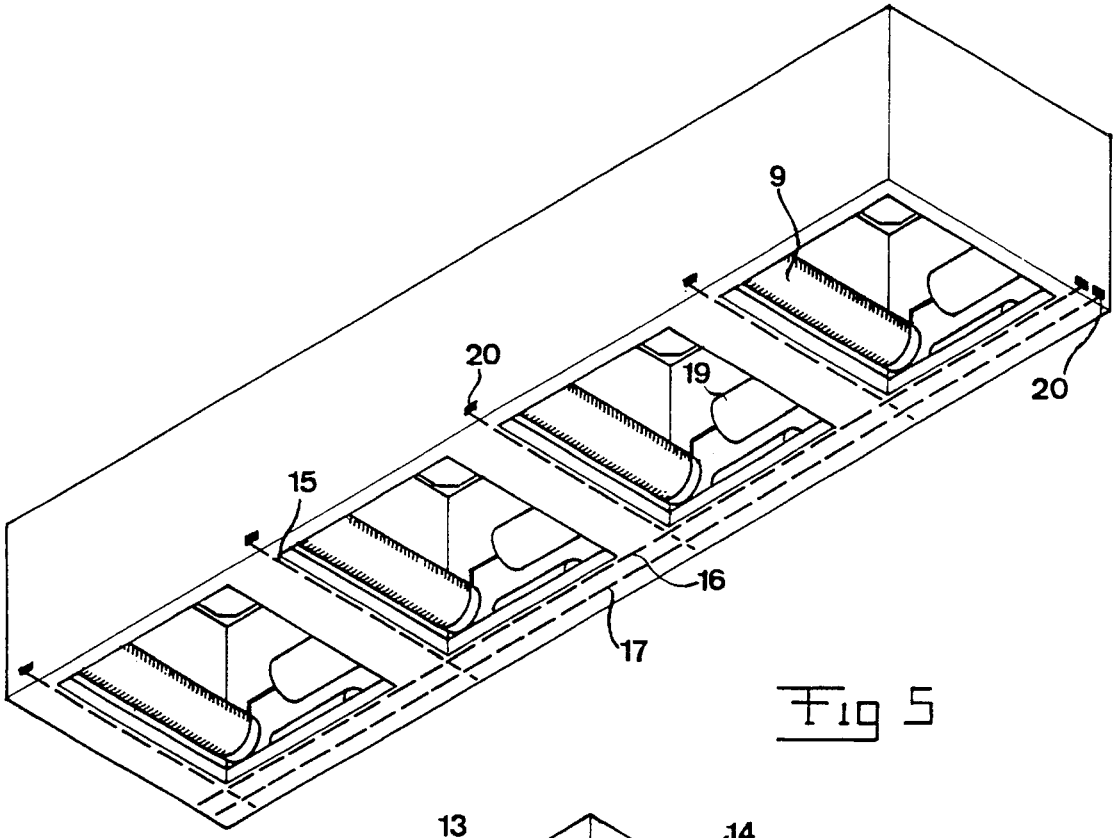
FIG. 5 is a simplified perspective view from below of a row or column module of a plurality of display elements according to FIG. 1.

It is shown in FIG. 5 how a module according to the invention made of a plurality of display elements arranged in a row may be realized. The different display elements are here constructed in accordance with FIGS. 1 and 2 and the connecting lines 15, 16, 17 are integrated with the module, so that only connecting means to corresponding interconnecting lines of other display elements or to a printed circuit card are required for the interconnecting lines 16 and 17 at the two display elements located at the end of the module. The connecting means 20 may be designed in any desired way, such as pins and recesses fitting thereto or pins projecting downwardly to a control card as shown in FIG. 4. Display elements according to FIG. 4 having interconnecting lines extending on a printed circuit card could of course also be arranged together in a row module according to FIG. 5.

Figure 7:
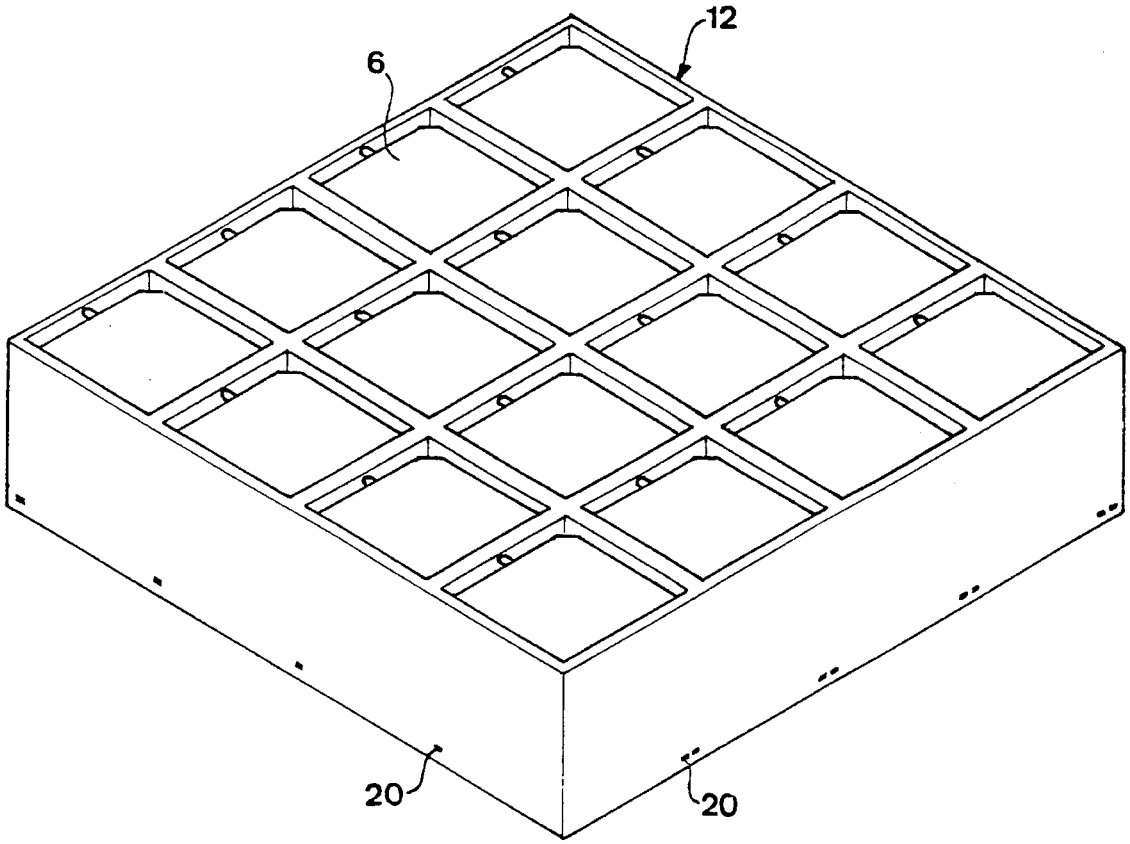
FIG. 7 is a view from above of the module according to FIG. 6.

In order to reduce the number of necessary connections to a printed circuit card, adjacent display elements or lines for supplying control signals from a control unit, a module constructed as a matrix, i.e. a two dimensional area, of rows and columns of display elements according to FIG. 6 may be arranged. This module is shown from the opposite direction in FIG. 7. The number of connecting means is here also reduced for the columns.

Figure 8:
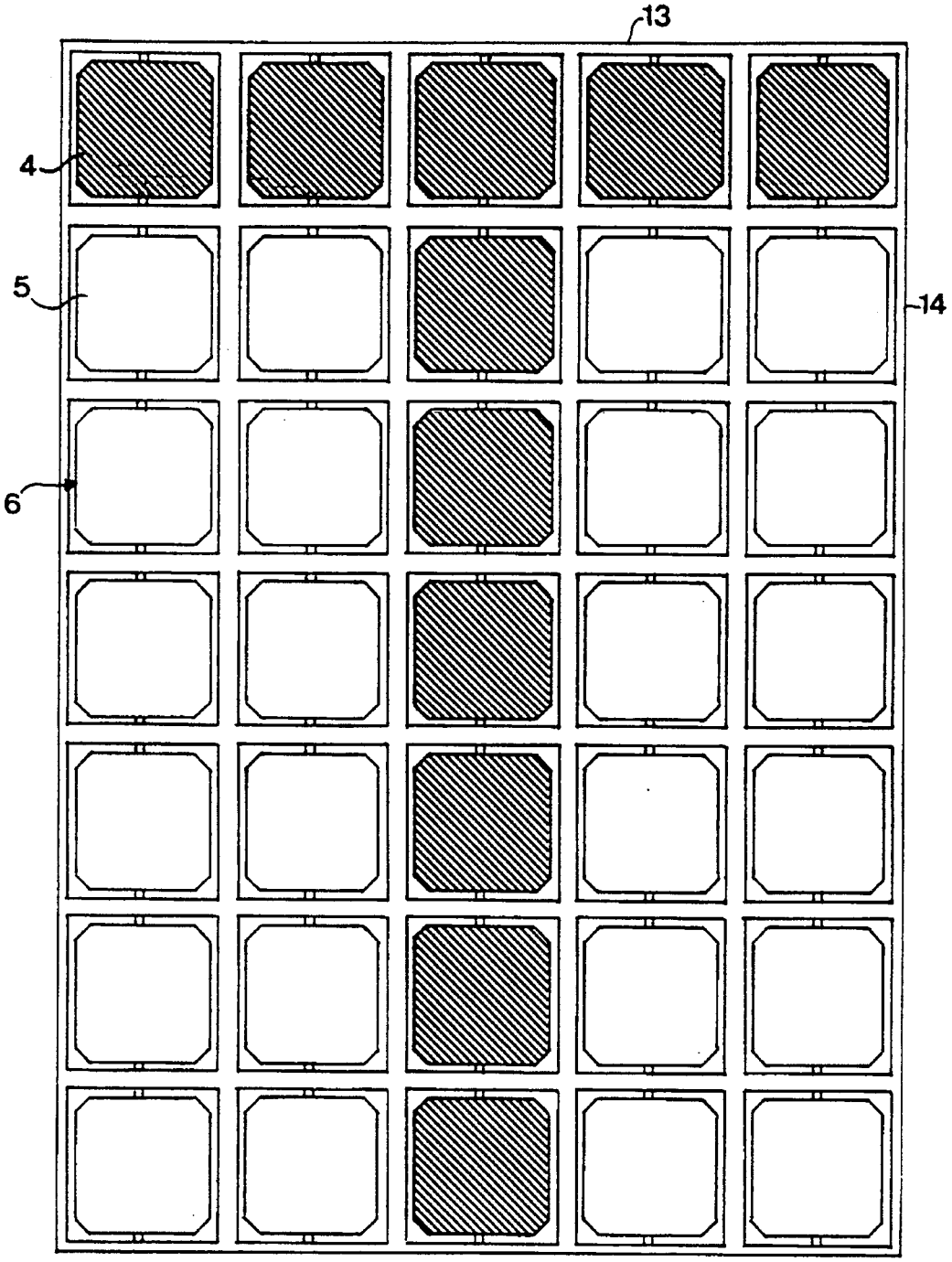
FIG. 8 is a-schematic view illustrating the principle of the display of signs by means of a matrix made of display elements according to the invention.

It is shown in FIG. 8 how display elements of the type according to the invention may be arranged in a matrix for displaying a sign, for instance a letter, and it is here illustrated how certain display elements have been remagnetized so as to show the letter T. The control mentioned above of the respective element is then carried out after a short delay with respect to the control of the following element, since remagnetizings not desired would otherwise occur. It would of course be quite possible to provide a matrix constructed in accordance with FIG. 6 which has the shape of the matrix shown in FIG. 8, so that a module is provided for a matrix for a letter. However, the matrix according to FIG. 8 could also be made of row or column module elements or partial row or column module elements or separate display elements.

In order to illustrate the considerable reduction of connections to a printed circuit card or to lines leading to a control unit of a matrix according to FIG. 8, which is made of display elements according to the invention having the interconnecting lines integrated with the elements, in relation to such a matrix made of display elements previously known, it may be mentioned that the display element according to the invention leads to 5+14=19 connections (one connection per column and two per row) in assembling on a control card, where connections are only needed at one end of each column and row, respectively, while the matrix previously known would have 2×35=70 connections (two for each coil), besides 2×2×35=140 diode connections required on a control card arranged under the matrix. Thus, the production of displaying units or displaying tables by means of the display element or the modules of display elements according to the invention is considerably simplified and the flexibility therein is increased with respect to what is previously known.

The invention is of course not in any way restricted to the preferred embodiments described above, but several possibilities to modifications thereof would be apparent to a man skilled in the art when reading the preceding description without departing from the basic idea of the invention.

For example display elements with different shapes of the housing and/or the surface element may very well be in the same module or be intended to be arranged beside each other in a row or column, and the definition "similar elements" in claim 1 is intended to comprise this possibility. A display element having an elongated surface element could for instance be arranged beside a display element having a substantially square surface element if desired.

The definition "housing" in the claims and the description is intended to comprise most different housing-like constructions, such as different types of frame works, frames and boxes, and these may have an arbitrary cross section shape, and it is also possible that these walls are opened and for instance are constituted by ribs spaced apart.

The expression "delimiting walls" in the claims is also intended to comprise the bottom of such a housing.

The definition "connecting means" in the claims is to be interpreted in its broadest sense and also comprises means for indirect connection of adjacent display elements to each other, such as through a control card. This is valid for the display element as well as the module of two or more such display elements according to the invention.

The notion "magnetizing" in the claims is also intended to comprise a remagnetizing of a coil already magnetized.

It is conceivable that the surface element displays one of its surfaces in only one of said positions, namely the display position, and that it in the other position turns an edge towards the viewer or shows the other surface in an acute angle to the latter.

Although a surface element being pivotally connected to the housing has been shown in the drawings, the invention is not in any way restricted thereto. Other movabilities between the surface element and the housing would also be conceivable for obtaining the different positions. The definition position in claim 1 is also intended to comprise states, i.e. it is not necessary that the surface element is even movably arranged, but the essential thing is that the direction of magnetizing of the magnetisable coil is decisive for which surface information the surface element displays. Accordingly, the surface element could be constituted by an element changing colour in dependence of said magnetizing direction.

The blocking means could just as well be one to the number for each display element, and the definition "blocking means" used in claim 1 comprises this as well as that such a means of course may be adapted to fulfil its function by opening certain current paths desired when certain signals, impulses, voltages and so on are applied thereon (i.e. block undesired current paths). Thus, a bi-directional thyristor, i.e. triac, is also comprised as the only blocking means for a display element according to the invention.

I claim:

1. A display element adapted to be arranged together with other similar elements (1) in rows (14) and columns (13) for displaying signs, said element comprising a housing (2) having outside walls; a surface element (6) connected to said housing and movable between two positions for displaying different surface information (4, 5); a coil (9) optionally magnetizable in opposite directions, said coil connected to the housing and adapted to actuate the surface element to occupy one or the other of said positions depending upon the direction of said magnetizing; said display element (1) being adapted to be selected to magnetize the coil thereof by activating a column or row to which it belongs through lines adapted to interconnect other similar display elements arranged in a column and a row, respectively, wherein said display element further comprises blocking means (18, 19) disposed within the housing (2) and arranged to block magnetizing of the coil of the display element on activation of an interconnecting line (15 and 16, 17, respectively) belonging to the row of the element last mentioned if the interconnecting line (16, 17 and 15, respectively) belonging to the column of this element is at the same time unactivated and conversely and thereby to assist in said selecting of the display element; and wherein said interconnecting lines are disposed within said housing and terminate at connection points located proximate the outside walls of the housing.

2. A display element according to claim 1, wherein said blocking means (18, 19) are connected in series with the coil (9) in an electrical connection between points (21, 22, 23) of the display element adapted for connection to a column (15) or a row interconnecting line (16, 17).

3. A display element according to claim 2, wherein said blocking means (18, 19) are two, connected in parallel to each other and adapted to permit conducting of electric current therethrough and thereby through the coil (9) in one direction and block such conducting in the opposite direction, and that the blocking means (18, 19) are designed to have mutually opposite such conducting and blocking directions.

4. A display element according to claim 3 wherein the blocking means (18, 19) are connected to the same, first end of the coil (9) and the sides thereof remote to said coil are adapted to be connected to one of said interconnecting lines (16, 17) each, the interconnecting lines last mentioned being either both related to a row of display elements or both to a column thereof, the other end of the coil being adapted to be connected to an interconnecting line (15) of a type being opposite to that of the blocking means with respect to column/row.

5. A display element according to claim 2 wherein the blocking means are formed by two semiconductor components (18, 19) connected in parallel.

6. A display element according to claim 5, wherein said semiconductor components (18, 19) are anti-parallelly coupled with respect to each other.

7. A display element according to claim 5, wherein said semiconductor components are diodes ( 18, 19).

8. A display element according to claim 1, wherein the blocking means (18, 19) are located inside the housing (2) on or in the delimiting walls thereof.

9. A display element according to claim 1 wherein the housing (2) is arranged to house a portion of said interconnecting line (15, 16, 17) for a column and a row, respectively, in which a display element is locatable, and that said portion is provided with connecting means (20) for connection to matching connecting means of an identical display element locatable adjacent to the display element.

10. A display element according to claim 1 wherein the coil comprises a winding (11) and a core (10) of a material having a high remanence receiving said winding, that the magnetizing of the coil is intended to take place by simultaneously applying an activating impulse to a connecting line for that row and one for that column to which the display element is intended to belong, and that the coil (9) is adapted to maintain the magnetizing caused by these impulses by means of the core (10) after these impulses have disappeared until impulses magnetizing the coil in the opposite direction are simultaneously applied thereto.

11. A display element according to claim 1 wherein the surface element (6) is provided with a permanent magnet (8) and is pivotally connected to the housing (2) between two positions for displaying different surfaces (4, 5), and wherein the magnetisable coil (9) is adapted to actuate the surface element to pivot between these two positions through actuation upon the permanent magnet (8).

12. A module of two or more display elements (1) according to claim 1, wherein said display elements being mutually assembled and forming together a part of a row (14) and/or a column (13) of a matrix of display elements.

13. A module according to claim 12, wherein said interconnecting lines (15, 16, 17) between display elements in said row and/or column part are integrated in the module.

14. A module according to claim 13, wherein the display elements located at the two ends of the respective row (14) or column (13) of display elements (1) included in the module are provided with connecting means (20) for connecting said interconnecting lines (15, 16, 17) for rows or columns in question to a matching connecting means of a display element adjacently located or a line for supplying signals activating the row or column.

15. A display module comprising:

a housing having an outside surface;

a surface element pivotally coupled to said housing between a first and a second position for displaying different surface information depending on the position of the surface element;

a coil coupled to said housing selectively magnetizable in opposite polarities to actuate said surface element to selectively display surface information;

a plurality of control lines integral with the housing, said plurality of control lines being electrically connected to said coil for controlling the polarity of said coil; and a plurality of connection points disposed on the outside surface of said housing, each of said connection points being electrically connected to said control lines and being adapted to make electrical contact with matingly similar connection points on other modules.

16. The display module of claim 15 wherein at least one of said connection points is comprised of a pin adapted to engage a corresponding recess formed in another module.

17. The display module of claim 15 wherein at least one of said connection points is comprised of a recess adapted to engage a corresponding pin formed on another module.

18. The display module of claim 15 wherein said connection points are comprised of projections extending downwardly from the housing.

19. The display module of claim 18 wherein said projections are adapted to connect to a carrier in the form of a control card.

20. The display module of claim 15 wherein a plurality of display modules are coupled together in the form of an array having rows an columns of said display modules.

21. The display module of claim 20 wherein said modules are each electrically connected to at least one adjacent module by said connection points.

22. The display element of claim 20 wherein said plurality of control lines includes a first control line corresponding to a row of modules and a second control line corresponding to a column of said modules.

23. The display module of claim 22 wherein the connection points of each control line corresponding to a row of modules is connected to a similar connection point on an adjacent module.

24. The display module of claim 22 wherein said plurality of control lines includes a third control line corresponding to a row of said modules.

25. The display module of claim 15 further comprising blocking elements integral with the housing and connected to said coil into at least one of said control lines to block the magnetizing of the coil when the magnetizing is not desired.

26. The display module of claim 25 wherein said blocking element are formed by two semi-conductor components.

27. The display module of claim 26 wherein said semiconductor components are comprised of diodes.

28. A display element adapted to be arranged together with other similar elements (1) in rows (14) and columns (13) for displaying signs, said element comprising a housing (2); a surface element (6) connected to said housing and movable between two positions for displaying different surface information (4, 5); a coil (9) optionally magnetizable in opposite directions, said coil connected to the housing and adapted to actuate the surface element to occupy one or the other of said positions depending upon the direction of said magnetizing; said display element (1) being adapted to be selected to magnetize the coil thereof by activating a column or row to which it belongs through lines adapted to interconnect other similar display elements arranged in a column and a row, respectively, wherein said display element further comprises blocking means (18, 19) integrated with the housing (2) and arranged to block magnetizing of the coil of the display element on activation of an interconnecting line (15 and 16, 17, respectively) belonging to the row of the element last mentioned if the interconnecting line (16, 17 and 15, respectively) belonging to the column of this element is at the same time unactivated and conversely and thereby to assist in said selecting of the display element.

* * * * *